US008813300B2

(12) United States Patent
Woo et al.

(10) Patent No.: US 8,813,300 B2
(45) Date of Patent: Aug. 26, 2014

(54) ROTARY TOOTHBRUSH

(76) Inventors: Jung Wan Woo, Daejeon (KR); Jung Tak Woo, Daejeon (KR); Man Joong Kim, Daejeon (KR); Jong Chan Park, Chungcheongbuk-do (KR)

( * ) Notice: Subject to any disclaimer, the term of this patent is extended or adjusted under 35 U.S.C. 154(b) by 275 days.

(21) Appl. No.: 13/375,400

(22) PCT Filed: May 20, 2010

(86) PCT No.: PCT/KR2010/003177
§ 371 (c)(1),
(2), (4) Date: Nov. 30, 2011

(87) PCT Pub. No.: WO2010/140784
PCT Pub. Date: Dec. 9, 2010

(65) Prior Publication Data

US 2012/0090108 A1 Apr. 19, 2012

(30) Foreign Application Priority Data

Jun. 3, 2009 (KR) ..... 10-2009-0049074

(51) Int. Cl.
*A46B 7/06* (2006.01)
*A46B 9/04* (2006.01)

(52) U.S. Cl.
USPC ..... 15/167.1; 15/172

(58) Field of Classification Search
USPC ..... 15/167.1, 172
See application file for complete search history.

(56) References Cited

U.S. PATENT DOCUMENTS

| | | | | |
|---|---|---|---|---|
| 4,333,199 | A * | 6/1982 | Del Rosario | 15/167.1 |
| 5,551,115 | A * | 9/1996 | Newville | 15/172 |
| 5,974,613 | A | 11/1999 | Herzog | |
| 7,472,447 | B2 * | 1/2009 | Lougheed | 15/144.1 |
| 2004/0068810 | A1 | 4/2004 | Lee | |

FOREIGN PATENT DOCUMENTS

| | | | |
|---|---|---|---|
| CN | 1166130 | | 11/1997 |
| CN | 2365952 | | 3/2000 |
| CN | 200966435 | | 10/2007 |
| DE | 3425940 | | 1/1986 |
| EP | 0173150 | | 3/1986 |
| JP | 63-153833 | U | 10/1988 |
| JP | 05-004919 | U | 1/1993 |
| KR | 20-1990-0019793 | U | 12/1990 |
| KR | 10-1995-0000459 | B1 | 1/1995 |
| KR | 20-0194839 | Y1 | 10/2000 |
| KR | 10-2004-0050700 | A | 6/2004 |

* cited by examiner

*Primary Examiner* — Randall Chin
(74) *Attorney, Agent, or Firm* — Brinks Gilson & Lione

(57) ABSTRACT

A rotary toothbrush includes a handle member to be held by a user; a head member having bristles and connected to the handle member; a tilting member, provided on the head member, for tilting upwardly the head member at a predetermined angle; a rotating member, provided on the handle member and the head member, for rotating the head member with respect to the handle member so that the head member is arranged in a T-shape with respect to the handle member; and a driving member for driving the head member to rotate and tilt the head member. With the rotary toothbrush, a user can freely brush his or her teeth in an upward and downward direction or in a left and right direction, and bristles can come into contact with a lower portion of front teeth to prevent dental plaque from getting buildup as much as possible.

14 Claims, 17 Drawing Sheets

<Related Art>

ROTARY TOOTHBRUSH

TECHNICAL FIELD

The present invention relates to a rotary toothbrush, and more particularly, to a rotary toothbrush capable of allowing a user to freely brush his or her teeth in an upward and downward direction or in a left and right direction, in which bristles can come into contact with a lower portion of front teeth.

BACKGROUND ART

Ordinary toothbrushes are configured in such a way that a head member with bristles is straight to a handle member.

When brushing teeth with such a straight-type toothbrush, the toothbrush is moved in a left and right direction, so that alien substances between teeth are not completely eliminated, and enamel is likely to be damaged, which may cause dental disease.

In order to prevent the above problem, a method of brushing teeth up and down from a gum to ends of teeth is recommended. In case of the straight-type toothbrush, however, since it is difficult to move the toothbrush up and down, a user brushes his or her teeth in a left and right direction by habit. Therefore, there is a problem in that it is not possible to prevent the enamel from being damaged.

In addition, there is another problem in that even though a user brushes his or her teeth up and down with the straight-type toothbrush, the carpal tunnel of the wrist is frequently moved to easily damage the carpal tunnel.

In order to easily brush teeth up and down, a T-shape toothbrush is disclosed in Korean Utility Model Registration No. 0266621.

In case of the conventional T-shape toothbrush, there is a problem in that brushing teeth up and down (when brushing front teeth and canine teeth) is easy, but brushing teeth from side to side (when brushing rear teeth) is not easy.

In addition, the front teeth of the lower jaw are generally configured to protrude to the top. In case of the conventional T-shape toothbrush, since bristles 121*a* are arranged in parallel with the front teeth, as shown in FIG. 1, the lower portion of the front teeth T' of the lower jaw do not come into contact with the bristles 121*a*.

At this time, in case where a handle member 110 is pulled toward the direction of the jaw in order to brush the lower portion of the front teeth T', the handle member 110 trips against the jaw, and thus the lower portion of the front teeth T' of the lower jaw do not come into contact with the bristles 121*a*. Therefore, since dental plaque gets buildup at the lower portion of the front teeth T' of the lower jaw, a user frequently flosses his or her teeth, thereby prolonging brushing time.

DISCLOSURE

Technical Problem

Therefore, the present invention has been made to solve the above-mentioned problems occurring in the related art, and an object of the present invention is to provide a rotary toothbrush capable of allowing a user to freely brush his or her teeth in an upward and downward direction or in a left and right direction, in which bristles can come into contact with a lower portion of front teeth

Technical Solution

In order to accomplish the above-mentioned objects, there is provided a rotary toothbrush including: a handle member to be held by a user; a head member having bristles and connected to the handle member; a tilting member, provided on the head member, for tilting upwardly the head member at a predetermined angle; a rotating member, provided on the handle member and the head member, for rotating the head member with respect to the handle member so that the head member is arranged in a T-shape with respect to the handle member; and a driving member for rotating and tilting the head member.

It is preferable that the head member includes a base with the bristles implanted therein, and a support integrally formed with a top surface of the base and inserted into and supported by the handle member.

It is preferable that the tilting member is formed in a spherical shape on an upper surface of the support, and is moved on the basis of a tilting support surface formed on the handle member.

It is preferable that the driving member includes a knob installed at an outside of the handle member and pushed in a forward and rearward direction, and a rod having front stepped inclined surface and a rear stepped inclined surface provided in the handle member and moved in a forward and rearward direction by operation of the knob.

It is preferable that the rotating member includes a rotating ball protruding from the tilting member and rotatably engaged to the rod; a first gear formed on an outer circumferential surface of the support; and a second gear formed on an inner surface of a rotation support surface which is formed on the handle member, and meshed with the first gear.

In addition, it is preferable that a front end of the handle member is provided with a stopper for stopping the head member not to tilt the head member more than a predetermined angle.

According to another aspect of the present invention, there is provided a rotary toothbrush including: a handle member to be held by a user; a head member having bristles and connected to the handle member; a tilting member, provided on the head member, for tilting upwardly the head member at a predetermined angle; a rotating member, provided on the handle member and the head member, for rotating the head member with respect to the handle member so that the head member is arranged in a T-shape with respect to the handle member; and a driving member for rotating and tilting the head member.

It is preferable that the head member includes a base with the bristles implanted therein, and a support integrally formed with a top surface of the base and inserted into and supported by the handle member.

It is preferable that the tilting member includes a tilting shaft formed on the base in a widthwise direction of the handle member, and a shaft support portion, formed on the support, for supporting the tilting shaft, in which the base is tilted around the tilting shaft with respect to the support.

It is preferable that the handle member includes a handle body to be held by the user, and an insertion body formed on a front end of the handle body in a shape slanted in a rearward direction, in which the support is inserted into the insertion body. In this instance, it is desirable that an inner surface of the insertion body is provided with a partition having an anti-reverse boss for preventing the support from being rotated in a reverse direction after the support is rotated at 90 degrees, and an upper surface of the support is provided with an anti-reverse groove into the anti-reverse boss is inserted.

It is preferable that the rotating member includes a rotating boss protruding from an inner surface of the insertion body along a circumferential direction, and a rotation groove, formed on an outer surface of the support, for guiding the rotating boss when the support is rotated.

It is preferable that the driving member has a knob installed on an outside of the handle body to be slidably moved in a forward and rearward direction, and locked to a fixing groove formed on the handle body, a rod, integrally connected to the knob in the handle body, for rotating the support, and a restoring member, provided in the handle body, for restoring the rod when the fixing boss is released from the fixing groove.

In addition, it is preferable that a pressing boss protrudes from a rear portion of a front end of the rod; a circumferential surface of the support is provided with a front end groove for supporting the front end of the rod when the rod is moved in a forward direction, and a pressing boss groove for supporting the pressing boss at a space spaced apart from the front end groove along a clockwise direction; and when the knob is moved in a forward direction, the support is rotated at a predetermined angle while the front end of the rod is supported by the front end groove, and then the support is further rotated by the pressing boss supported by the pressing boss groove to rotate the support at 90 degrees.

In addition, the rotary toothbrush further includes a cap for covering the insertion body. The driving member further includes a guide boss protruding downwardly from a front end of the cap, and a guide groove recessed on the base in such a way that its depth is deepened from a center to both sides, in which when the base is rotated around the rotating member, the guide boss is moved along the guide groove and is tilted around the tilting member.

It is preferable that the cap has a push-type button for separating the head member.

Advantageous Effects

As described above, with the rotary toothbrush according to the present invention, when the head member is formed in the T-shape with respect to the handle member, the head member is tilted upwardly at the predetermined angle. Therefore, the bristles can come into contact with the lower portion of the front teeth of the lower jaw, thereby preventing dental plaque from getting buildup and shortening a tooth brushing time.

In addition, since the head member and the handle member can be freely rotated (that is, the head member is straight to the handle member or is formed in the T-shape with respect to the handle member), the head member can be conveniently rotated in such a way that the straight state is selected when brushing rear teeth, while the T-shaped state is selected when brushing front teeth.

BRIEF DESCRIPTION OF THE DRAWINGS

The above objects, other features and advantages of the present invention will become more apparent by describing the preferred embodiments thereof with reference to the accompanying drawings, in which.

BEST MODE

Figure 1:
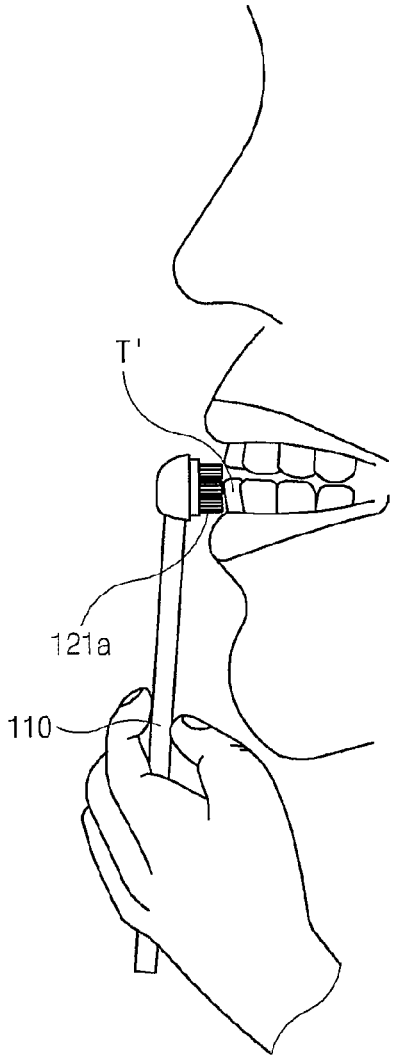
FIG. 1 is a view illustrating problems contained in a T-shape toothbrush in the related art.

Now, preferred embodiments of the present invention will be described in detail with reference to the accompanying drawings. The embodiments described below are merely exemplary and is not to be construed as limiting the present invention. The description of the present invention is intended to be illustrative, and not to limit the scope of the claims. In the description of the embodiment of the present invention, the same drawing reference numerals are used for the same elements even in different drawings, and the duplicate explanation thereof will be omitted.

Embodiment 1

Figure 2:
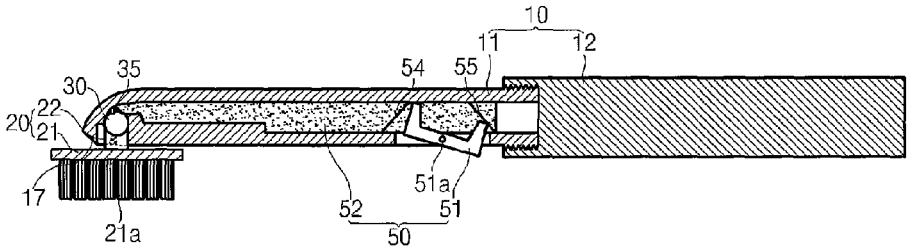
FIG. 2 is a cross-sectional view illustrating a rotary toothbrush according to a first embodiment of the present invention.
Figure 3:
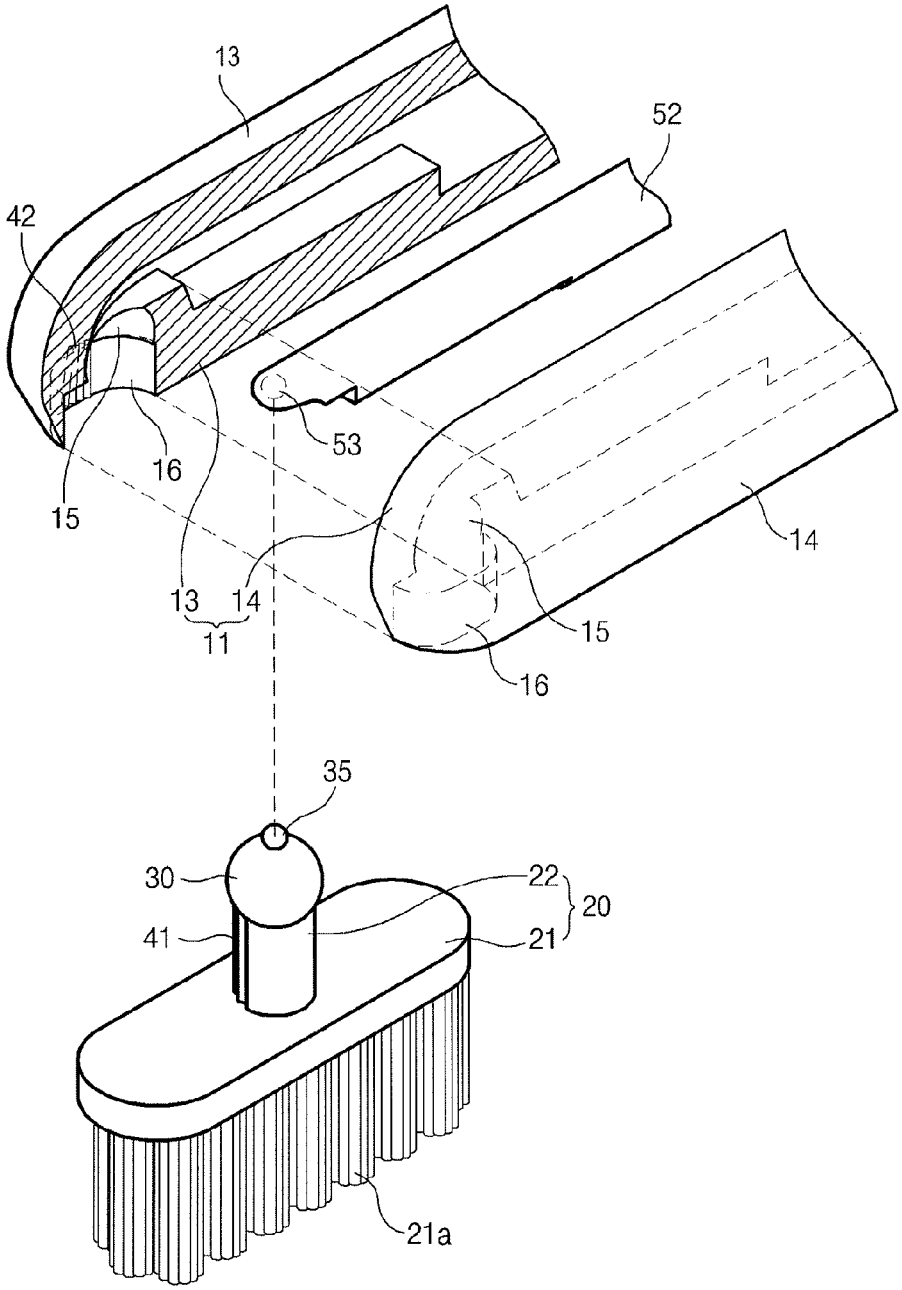
FIG. 3 is an exploded perspective view illustrating the main configuration of the toothbrush in FIG. 2.
Figure 4:
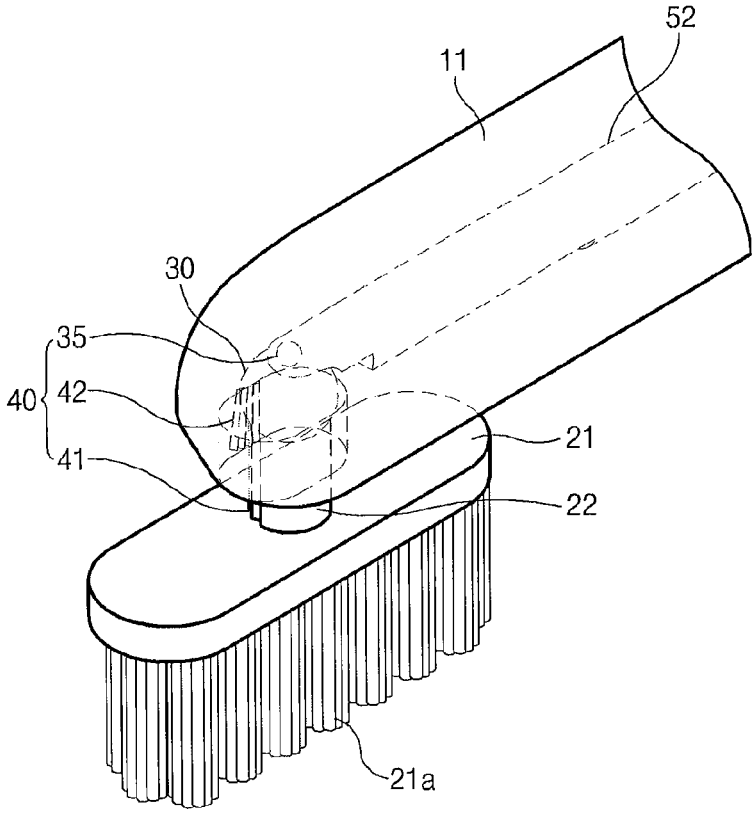
FIG. 4 is a perspective illustrating the assembled state of the toothbrush in FIG. 3.

A rotary toothbrush 1 according to the first embodiment of the present invention includes, as shown in FIGS. 2 to 4, a handle member 10, a head member 20 having bristles 21*a*, a tilting member 30 for tilting the head member 20 with respect to the handle member 10 at a predetermined angle, a rotating member 40 for rotating the head member 20 to be formed in a T-shape with respect to the handle member 10, and a driving member 50 for rotating and tilting the head member 20.

The handle member 10 is designed to be held by a user, and is made to have a first handle portion 11 and a second handle portion 12, in which the first handle portion 11 and the second handle portion 12 are integrally coupled to each other by a thread manner. The coupling structure of the first handle portion 11 and the second handle portion 12 is not limited thereto, and may include any coupling structure known in the art.

The first handle portion 11 has a left body 13 and a right body 14 which are separate made and then are integrally coupled to each other. The coupling structure of the left body 13 and the right body 14 may be formed in a recessed structure, but is not limited thereto. Any coupling structure known in the art may be employed.

A rod 52 described below is slidably moved in the inner portion of the first handle portion 11. The front end of the first handle portion 11 is provided with a stopper 17 for stopping the head member 20, the stopper downward extending from the front end so that when the head member 20 is tilted in an upward direction by the tilting member 30, the head member is not tilted more than a predetermined angle θ (see FIG. 6).

The tilting angle θ of the head member 20 is approximately 5 to 40 degrees, preferably 20 degrees. To this end, the stopper 17 should extend from the front end of the first handle 11 to an extent in which the head member 20 is not tilted more than approximately 20 degrees.

The head member 20 includes the base 21 with the bristles 21*a* implanted in a bottom surface, and a support 22 integrally formed with the top surface of the base 21 and inserted into and supported by the first handle portion 11.

The outer circumferential surface of the support 22 is formed with a first gear 41 forming the rotating member 40.

The tilting member 30 is formed in a spherical shape on the upper surface of the support 22, and is moved on the basis of the tilting support surface 15 formed on the first handle portion 11. The tilting member 30 is provided with a rotating ball 35 protruding therefrom. The rotating ball 35 is integrally coupled to the rod 52 to be rotated in the rotating ball engaging groove 53 formed in the rod 52.

The tilting support surface 15 is formed to be symmetrical to the left body 13 and the right body 14 which are separately made.

The rotating member 40 is designed to rotate the head member 20, which is straight to the handle member 10, at approximately 90 degrees so that the head member 20 is formed in the T-shape with respect to the handle member 10. The rotating member 40 has a rotating ball 35 rotatably engaged to a rotating ball engaging groove 53 which is formed in the rod 52 protruding from the tilting member 30, a first gear 41 formed on the outer circumferential surface of the support 22, and a second gear 42 formed on the inner surface of the rotation support surface 16 which is formed on the first handle portion 11, and meshed with the first gear 41.

The rotation support surface 16 is formed on the lower portion of the tilting support surface 15 to communicate with the tilting support surface 15, and is formed to be symmetrical to the left body 13 and the right body 14 which are separately made.

The driving member 50 is designed to simultaneously rotate and tilt the head member 20, and has a knob 51 installed at the outside of the first handle portion 11, and the rod 52 moved forth and back in conjunction with the knob 51 to operate the tilting member and the rotating member 40.

The knob 51 is installed at the outside of the first handle portion 11 in such a manner that the knob can be pushed down in a front and rear direction on the basis of a shaft 51*a*.

Figure 5:
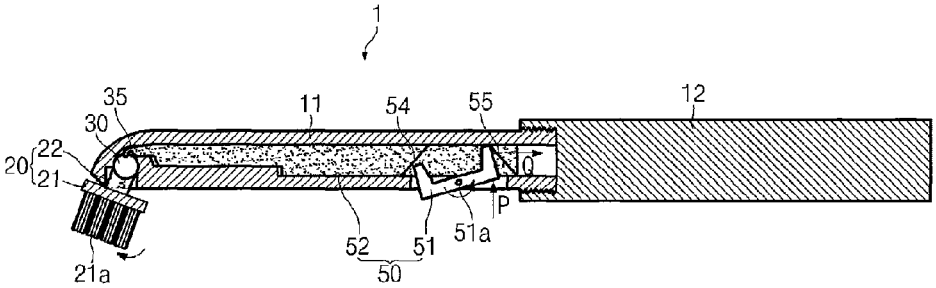
FIG. 5 is a cross-sectional view illustrating the state in which a head member is upwardly tilted at approximately 20 degrees and then is rotated at approximately 90 degrees to form a T shape with respect to a handle member, when a rear portion of a knob is pushed down from the state shown in FIG. 2.

The rod 52 is installed to be slid in a front and rear direction along a pushing direction of the knob 51 in the first handle portion 11. If a user pushes down the rear portion of the knob 51 on the basis of the shaft 51*a* (see P in FIG. 5), the rod 52 is moved rearward (see Q in FIG. 5), while if the user pushes down the front portion of the knob 51, the rod 52 is moved forward. To this end, the rod 52 is provided with a front stepped inclined surface 54 and a rear stepped inclined surface 55. Therefore, if the rear portion of the knob 51 is pushed down in a direction P, the rear stepped inclined surface 55 is pressed, and the rod 52 is moved rearward in a direction Q (see FIG. 5). If the front portion of the knob 51 is pushed down, the front stepped inclined surface 54 is pressed, and the rod 52 is moved forward and thus is returned to its original position (see FIG. 2).

The front end of the rod 52 is provided with the rotating ball engaging groove 53 to which the rotating ball 35 is rotatably engaged.

With the above configuration, the tilting and rotating principle of the rotary toothbrush 1 according to the first embodiment of the present invention will now be described with reference to FIGS. 7 to 9.

Figure 7:
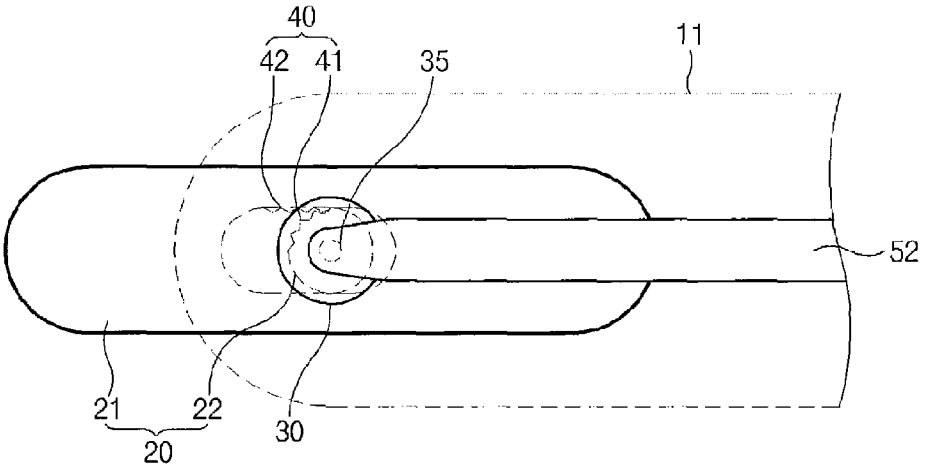
FIG. 7 is a cross-sectional view illustrating the state in which the head member is straight with respect to the handle member.

First, the initial state of the head member 20 and the handle member 10 which are arranged in the straight shape is shown in FIG. 7.

Figure 8:
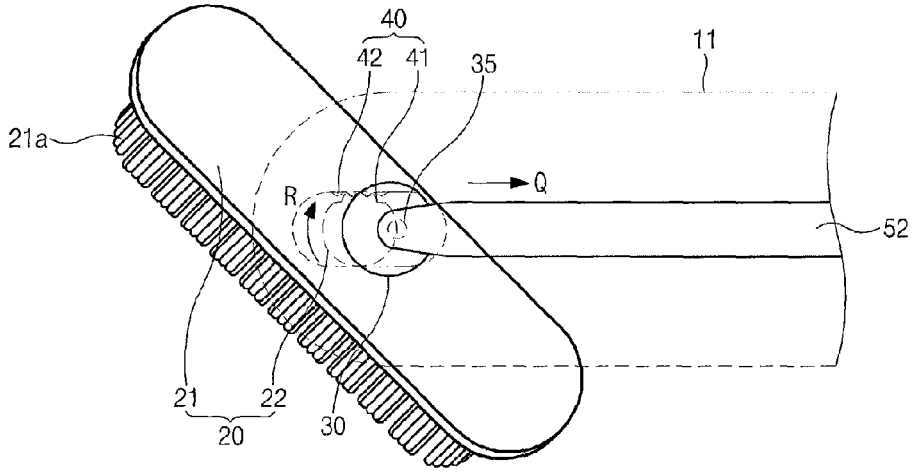
FIG. 8 is a cross-sectional view illustrating the state in which the head member is upwardly tilted at approximately 45 degrees and then is rotated at approximately 90 degrees, when a rod is moved rearward by pressing down the knob.

When the user slightly pushes down the rear portion of the knob 51 in the direction P (see FIG. 5), the rear stepped inclined surface 55 is pressed by the knob 51 and thus the rod 52 is lightly moved back in the direction Q, as shown in FIG. 8. Since the tilting member 30 is moved rearward and is rotated in the direction R together with the rotating ball 35, the head member 20 connected to the tilting member 30 is tilted in the upward direction, and simultaneously is rotated at approximately 45 degrees. In this instance, when the tilting member 30 is rotated, the first gear 41 of the support 22 is meshed with the second gear 42, and thus the head member 20 is rotated.

Figure 9:
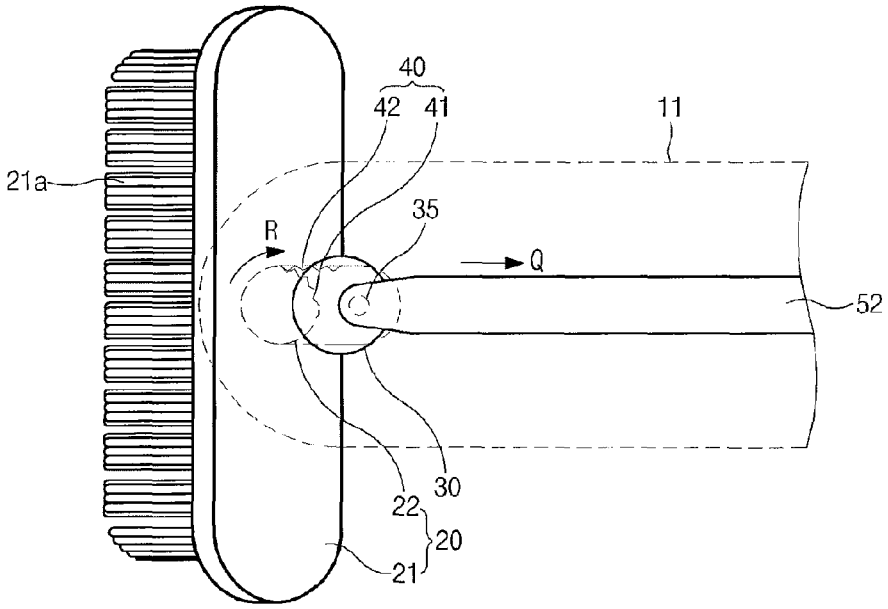
FIG. 9 is a plan view illustrating the state in which the head member is tilted at approximately 20 degrees, as compared with FIG. 8, and then is rotated at approximately 90 degrees to form a T shape with respect to the handle member when the rod is further moved rearward.

Next, the rear portion of the knob 51 is fully pressed in the direction P from the state shown in FIG. 8, the rod 52 is completely moved back in the direction Q, as shown in FIG. 9. Since the tilting member 30 is fully moved back and then is rotated in the direction R together with the rotating ball 35, the head member 20 connected to the tilting member 30 is fully tilted in the upward direction, and can be further rotated to approximately 45 degrees. In this instance, when the tilting member 30 is rotated, the first gear 41 of the support 22 is meshed with the second gear 42, and thus is further moved, so that the head member 20 is completely rotated.

Figure 6:
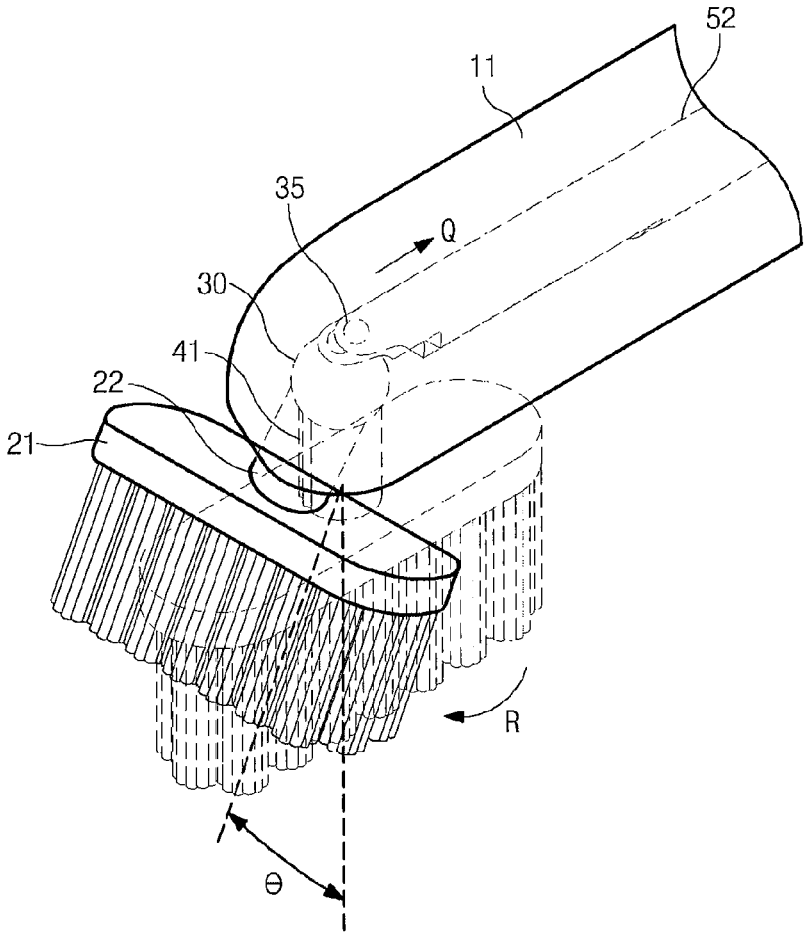
FIG. 6 is a cross-sectional view schematically illustrating the tilting extent of the head member to the handle member, when the head member is rotated from a straight state with respect to the handle member to form the T shape with respect to the handle member.

After all, FIG. 6 shows the state in which the head member 20 is formed in the T-shape with respect to the handle member 10 through the process shown in FIGS. 7 to 9. That is, although the head member 20 is initially straight to the handle member 10, the head member 20 is tilted at a predetermined angle θ by pushing the knob 51, and simultaneously is rotated at approximately 90 degrees, so that the head member is formed in the T-shape with respect to the handle member 10.

Figure 10:
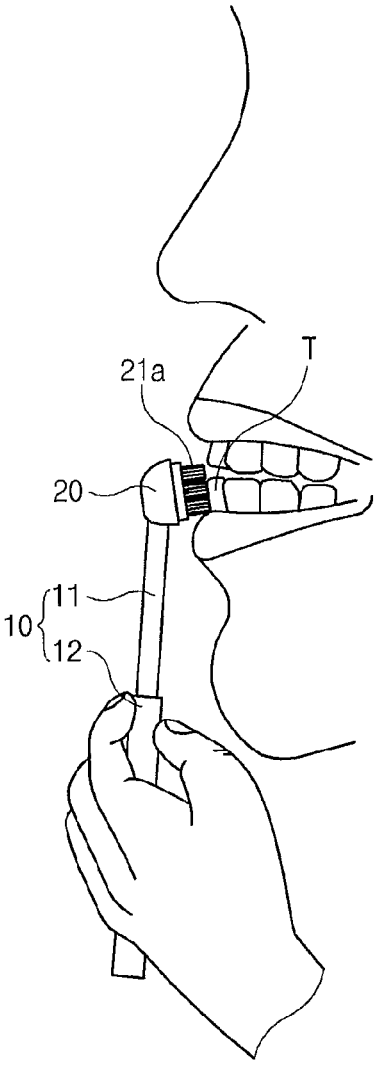
FIG. 10 is a side view schematically illustrating the state in which bristles comes into contact with a lower portion of front teeth, when brushing the teeth in the state in FIG. 5.

With the rotary toothbrush 1 according to the first embodiment of the present invention, when the head member 20 is formed in the T-shape with respect to the handle member 10, the head member 20 is tilted upwardly at the predetermined angle θ. Therefore, the bristles 21*a* can come into contact with the lower portion of the front teeth T of the lower jaw, as shown in FIG. 10, thereby preventing dental plaque from getting buildup and shortening a tooth brushing time.

In addition, since the head member 20 and the handle member 10 can be freely rotated (that is, the head member 20 is straight to the handle member 10 or is formed in the T-shape with respect to the handle member), the head member can be conveniently rotated in such a way that the straight state is selected when brushing rear teeth, while the T-shaped state is selected when brushing front teeth.

Embodiment 2

A rotary toothbrush 201 according to the second embodiment of the present invention is substantially identical to the rotary toothbrush 1 according to the first embodiment in view of that a head member 220 is rotated to be formed in a T-shape with respect to a handle member 210 and simultaneously is tilted in an upward direction at a predetermined angle. The structure to achieve the above technical though will now be described with reference to FIGS. 11 to 14.

The rotary toothbrush 201 according to the second embodiment of the present invention includes the handle member 210, the head member 220 having bristles 221*a*, a tilting member 230 for tilting the head member 220 with respect to the handle member 210 at a predetermined angle, a rotating member 240 for rotating the head member 220 to be formed in a T-shape with respect to the handle member 210, and a driving member 250 for rotating and tilting the head member 220.

The handle member 210 has a handle body 211 to be held by a user, and an insertion body 212 formed on the front end of the handle body 211 in a shape slanted in a rearward direction, in which the support 222 of a base 221 described below is inserted into the insertion body 212.

The inner surface of the insertion body 212 is provided with a partition 213, and an anti-reverse boss 214 is formed on the bottom surface of the partition 213 and is inserted into an anti-reverse groove 223 formed in the support 222. The surface of the partition 213 is provided with a through-hole 213*a* through which pressing legs 272 of a button 270 described below penetrate.

The head member 220 has the base 221 with the bristles 221*a* implanted thereon, and the support 222 integrally coupled to the upper surface of the base 221 and inserted into and supported by the insertion body 212.

The base 221 is coupled to the support 222 by the tilting member 230 such that the base 221 can be tilted in an upward and downward direction with respect to the support 222.

The circumferential surface of the support 222 is provided with a front end groove 222*a* for supporting the front end 252*a* (see FIG. 15) of the rod 252, and a pressing boss groove 22*b* for supporting a pressing boss 253 at a space spaced apart from the front end groove 222*a* along a clockwise direction. The front end groove 222*a* and the pressing boss groove 222*b* make a pair, and the support 222 can rotate at 90 degrees. In this embodiment, the front end groove 222*a* and the pressing boss groove 222*b* make four pairs, and thus the support 222 can rotate at 360 degrees.

In addition, the upper surface of the support 222 is provided with anti-reverse grooves 223 at 90 degree interval to receive an anti-reverse boss 214. Whenever the support 222 rotates from zero degree to 90 degrees, the anti-reverse boss 214 is inserted into the anti-reverse groove 223, so that the support 222 is fixed at the position.

The tilting member 230 has a tilting shaft 231 formed on the base 221 in a widthwise direction of the handle member 210, and a shaft support portion 232, formed on the support 222, for supporting the tilting shaft 231.

The rotating member 240 is designed to rotate the head member 220 at 360 degrees with respect to the handle member 210, and has a rotating boss 241 protruding from the inner surface of the insertion body 212 along a circumferential direction, and a rotation groove 242, formed on the outer surface of the support 222, for guiding the rotating boss 241 to rotate the support 222.

In order to assemble the rotating boss 241 into the rotation groove 242, it is preferable to provide the upper surface of the support 222 with a plurality of cut lines 224 in a radial direction. The support 222 is generally made of a plastic material having desired resilience. The cut lines 224 are formed on the upper surface so that the upper surface is given by further resilience. Therefore, when the support 222 is inserted into the insertion body 212, the upper surface is slightly resiliently deformed, and thus the rotating boss 241 is inserted into the rotation groove 242.

The driving member 250 has a knob installed on the outside of the handle body 211 to be slidably moved in a forward and rearward direction, a rod 252, integrally connected to the knob 251 in the handle body 211, for rotating the support 222, and a restoring member 254, provided in the handle body 211, for restoring the rod 252.

The front end of the knob 251 is provided with a fixing boss 251*a* which is locked to the fixing groove 211 formed on the outside of the handle body 211.

The rod 252 is integrally formed with the knob 251, and is moved together with the knob 251 when the knob is slid in a forward and rearward direction. If the knob 251 is moved in the forward direction, the rod 252 is also moved straightly in the forward direction to press and rotate the support 222. If the knob 251 is moved in the rearward direction, the rod is also straightly moved in the rearward direction to return to its original direction.

The pressing boss 253 protrudes in a widthwise direction from a one side of the front end 252*a* of the rod 252. The pressing boss 253 is locked to the pressing boss groove 222*b* formed on the support 222, and thus rotates completely the support 222 by 90 degrees. That is, if the front end 252*a* of the rod 252 is locked to the front end groove 222*a* to rotate the support 222 at a predetermined angle, the pressing boss 253 positioned at the rear portion of the front end 252*a* of the rod 252 is locked to the pressing boss groove 222*b*, and thus further rotate the support 222, so that the support 222 is completely rotated to 90 degrees.

Figure 11:
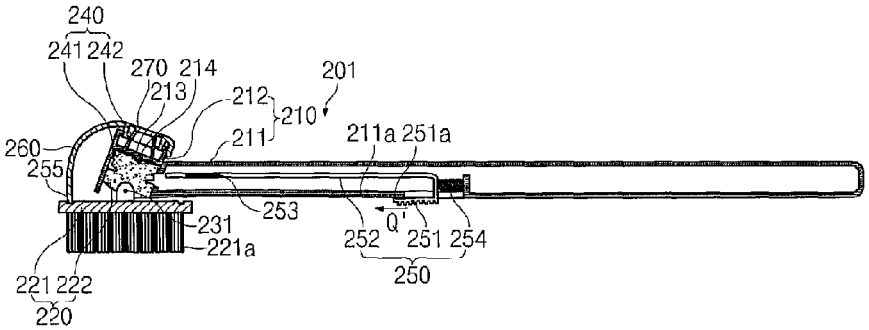
FIG. 11 is a cross-sectional view illustrating a rotary toothbrush according to a second embodiment of the present invention.
Figure 12:
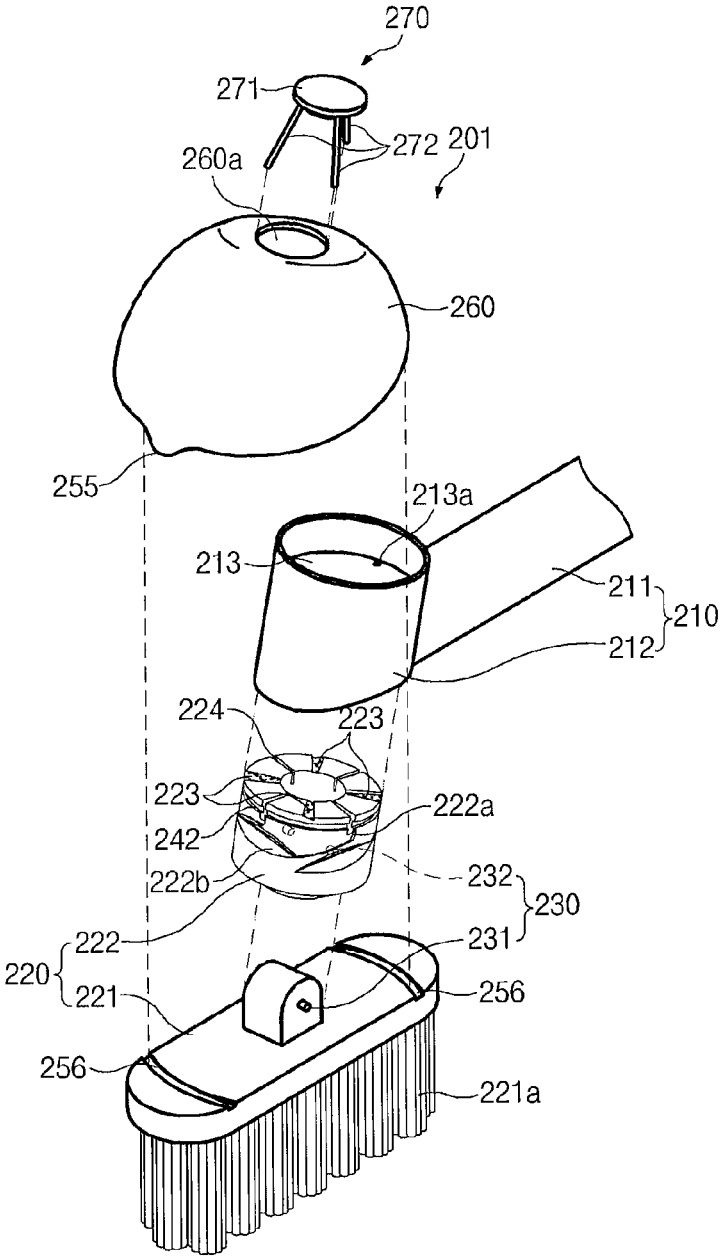
FIG. 12 is an exploded perspective view illustrating the main configuration of the toothbrush in FIG. 11.
Figure 13:
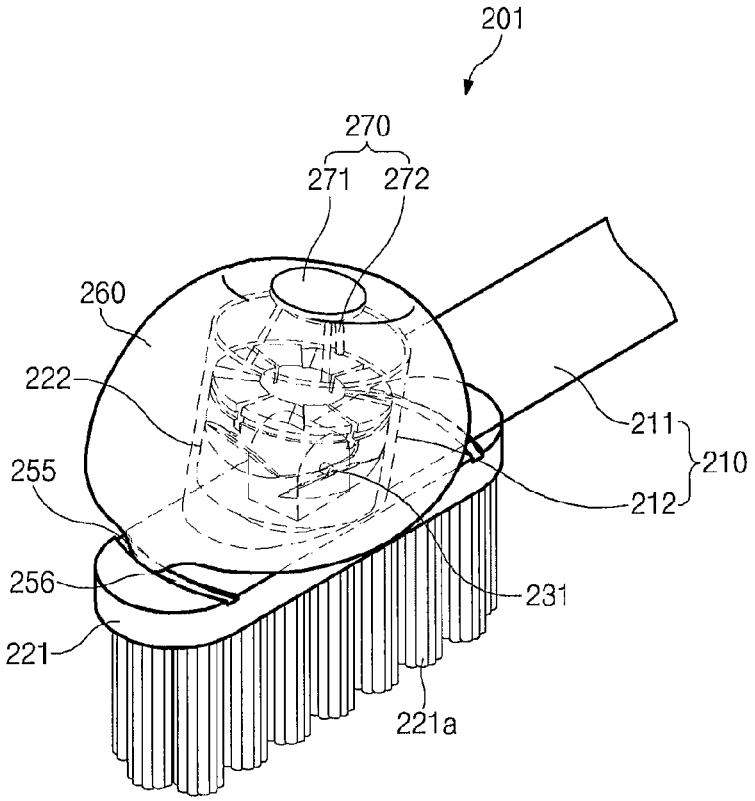
FIG. 13 is a perspective view illustrating the assembled state of the toothbrush in FIG. 12.
Figure 14:
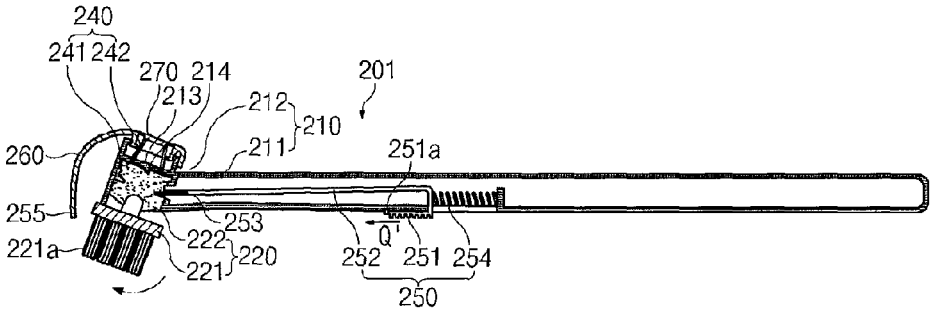
FIG. 14 is a cross-sectional view illustrating the state in which a head member is upwardly tilted at approximately 20 degrees and then is rotated at approximately 90 degrees to form a T shape with respect to a handle member, when a knob is slid in a direction Q' from the state shown in FIG. 11.

The restoring member 254 has one end coupled to the handle body 211 and the other end coupled to the rod 252. Usually, the restoring member 254 is compressed, as shown in FIG. 11, but as the knob 251 is moved forwardly, the restoring member is extended, as shown in FIG. 14. In this instance, after the knob 251 is moved forwardly as shown in FIG. 14, the fixing boss 251*a* is inserted into the fixing groove 211*a*, the head member 220 is rotated at 90 degrees with respect to the handle member 210. If the fixing boss 251*a* is released from the fixing groove 211*a*, the knob 251 is automatically restored by the restoring force of the restoring member 254, as shown in FIG. 11.

Meanwhile, when the support 222 is rotated by the rod 252, the base 221 is tilted with respect to the support 222. To this end, the front end of a cap 260 covering the insertion body 212 is provided with a guide boss 255, and the base 221 is provided with a guide groove 256 for guiding the guide boss 255.

The guide boss 255 protrudes downwardly from the front end of the cap 260, and the guide groove 256 is recessed on the surface of the base 221 in such a way that its depth is deepened from the center to both sides.

The guide groove 256 is formed at the front and rear portions of the base 221 respectively, in order to guide the guide boss 255 when the head member 220 rotates from 0 degree to 360 degrees.

A push-type button 270 is engaged to the cap 260 to separate the head member 220 coupled to the insertion body 212. If the bristles 221 are worn, a user pushes the button 270 down to separate the head member 220 from the handle member 210, thereby replacing it by a new head member. To this end, the upper surface of the cap 260 is provided with a button operating portion 260*a* for pushing the button 270 down.

The button 270 has an operation body 271 to be pushed by the user, and a pushing ridge 272 extended from the bottom surface of the operation body 271 and passing through the through-hole 213*a* formed in the partition 213 to come into contact with the upper surface of the support 222. If the user pushes the button 270 down to replace the head member 220, the pressing ridge 272 which is into contact with the upper surface of the support 222 pushes the support 222 in a downward direction by the pressing force, and thus the locking between the rotating boss 241 and the rotation groove 242 is released, so that the head member 220 can be separated from the handle member 210.

Figure 15:
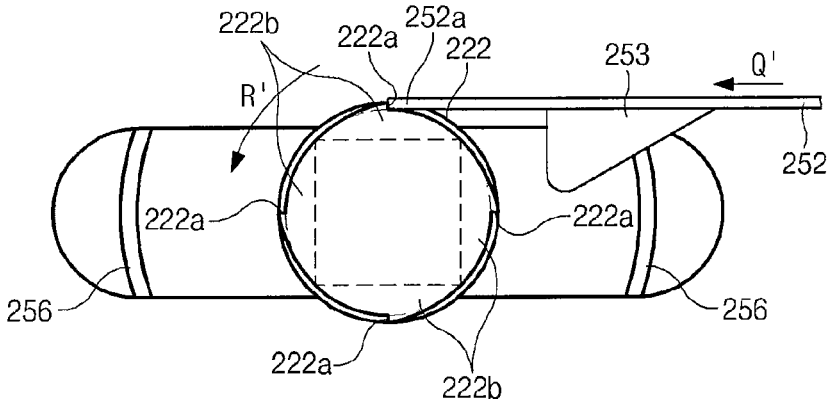
FIG. 15 is a cross-sectional view illustrating a front end of the rod is supported by a front end groove, when the knob is further slid.

With the above configuration, the tilting and rotating principle of the rotary toothbrush 201 according to the second embodiment of the present invention will now be described with reference to FIGS. 15 to 17.

First, the initial state of the head member 220 and the handle member 210 which are arranged in the straight shape is shown in FIG. 11. In this instance, if the user pushes the knob 251 in the direction Q', the front end 252*a* of the rod 252 is supported by the front end groove 222*a* of the support 222, as shown in FIG. 15.

Figure 16:
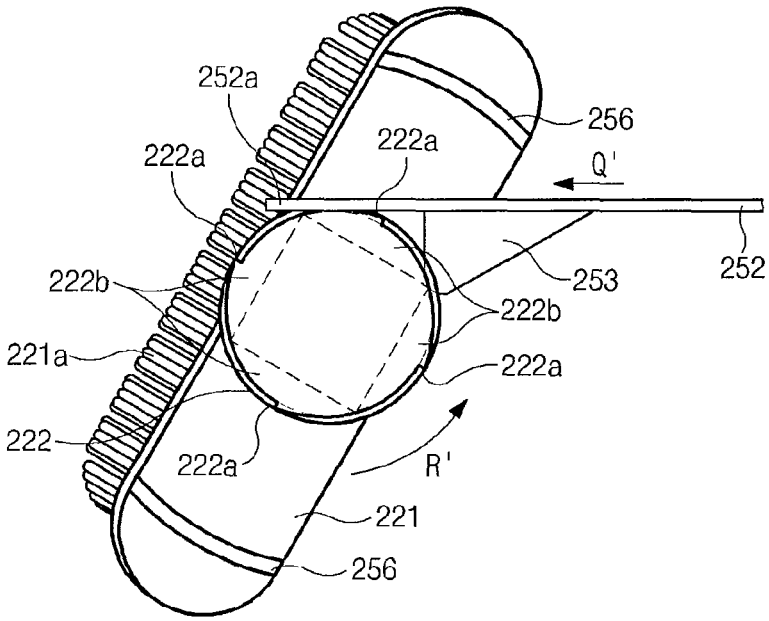
FIG. 16 is a cross-sectional view illustrating the state in which a support is tilted and then is rotated at approximately 60 degrees when the knob is further pushed in a forward direction from the state shown in FIG. 15.
Figure 17:
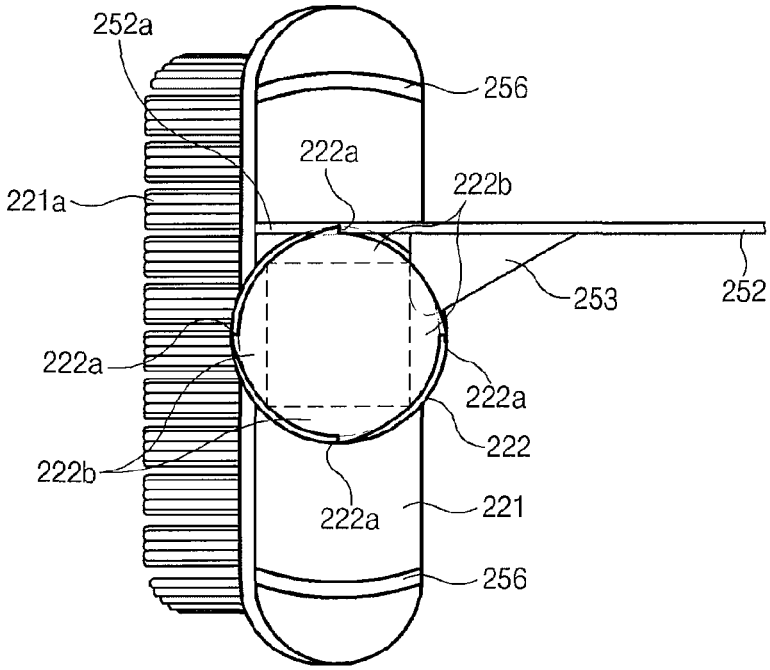
FIG. 17 is a cross-sectional view illustrating the state in which the support is tilted at approximately 20 degrees and then is rotated at approximately 90 degrees such that the head member forms a T shape with respect to the handle member, when the knob is pushed in a forward direction to the maximum from the state shown in FIG. 16.

After that, if the user further pushes the knob 251 in the direction Q', the front end 252*a* of the rod 252 is further moved in the forward direction while being supported by the front end groove 222*a*, as shown in FIG. 16, and thus the support 222 is rotated in the direction R' by approximately 60 degrees. In this instance, the pressing boss 253 comes into contact with the pressing boss groove 222*b* of the support 222. While the support 222 is rotated at approximately 60 degrees, the base 221 is tilted in the upward direction around the tilting shaft 231.

Next, if the user further pushes the knob 251 in the direction Q', the front end 252*a* of the rod 252 is released from the front end groove 222*a*. In this instance, if the pressing boss 253 is moved while being supported by the front end groove 222*a*, as shown in FIG. 17, the support 222 is further rotated in the direction R', and thus the head member 220 is arranged at 90 degrees (T-shape) with respect to the handle member 210, as shown in FIG. 14. While the support 222 is rotated from approximately 60 degrees to 90 degrees, the base 221 is completely tilted in the upward direction around the tilting shaft 231.

While the support 222 is rotated from 0 degree to 90 degrees, the tilting angle of the base 221 around the tilting shaft 231 is preferably approximately 5 to 40 degrees, more preferably 20 degrees.

With the rotary toothbrush 201 according to the second embodiment of the present invention, when the head member 220 is formed in the T-shape with respect to the handle member 210, the head member 220 is tilted upwardly at the predetermined angle θ, as described in the first embodiment. Therefore, the bristles 221*a* can come into contact with the lower portion of the front teeth T of the lower jaw, thereby preventing dental plaque from getting buildup and shortening a tooth brushing time.

In addition, since the head member 220 and the handle member 210 can be freely rotated (that is, the head member 220 is straight to the handle member 210 or is formed in the T-shape with respect to the handle member), the head member can be conveniently rotated in such a way that the straight state is selected when brushing rear teeth, while the T-shaped state is selected when brushing front teeth.

Although preferred embodiments of the present invention have been described for illustrative purposes, those skilled in the art will appreciate that various modifications, additions and substitutions are possible, without departing from the scope and spirit of the invention as disclosed in the accompanying claims.

The invention claimed is:

1. A rotary toothbrush comprising: a handle member to be held by a user; a head member having bristles and connected to the handle member; a tilting member, provided on the head member, for tilting upwardly the head member at a predetermined angle; a rotating member, provided on the handle member and the head member, for rotating the head member with respect to the handle member so that the head member is arranged in a T-shape with respect to the handle member; and a driving member for rotating and tilting the head member; wherein the head member includes a base with the bristles implanted therein, and a support integrally formed with a top surface of the base and inserted into and supported by the handle member.

2. The rotary toothbrush according to claim 1, wherein the tilting member is formed in a spherical shape on an upper surface of the support, and is moved on the basis of a tilting support surface formed on the handle member.

3. The rotary toothbrush according to claim 2, wherein the driving member includes a knob installed at an outside of the handle member and pushed in a forward and rearward direction, and a rod having front stepped inclined surface and a rear stepped inclined surface provided in the handle member and moved in a forward and rearward direction by operation of the knob.

4. The rotary toothbrush according to claim 3, wherein the rotating member includes a rotating ball protruding from the tilting member and rotatably engaged to the rod; a first gear formed on an outer circumferential surface of the support; and a second gear formed on an inner surface of a rotation support surface which is formed on the handle member, and meshed with the first gear.

5. The rotary toothbrush according to claim 1, wherein a front end of the handle member is provided with a stopper for stopping the head member not to tilt the head member more than a predetermined angle.

6. The rotary toothbrush according to claim 1, wherein the tilting member includes a tilting shaft formed on the base in a widthwise direction of the handle member, and a shaft support portion, formed on the support, for supporting the tilting shaft, in which the base is tilted around the tilting shaft with respect to the support.

7. The rotary toothbrush according to claim 6, wherein the handle member includes a handle body to be held by the user, and an insertion body formed on a front end of the handle body in a shape slanted in a rearward direction, in which the support is inserted into the insertion body.

8. The rotary toothbrush according to claim 7, wherein the rotating member includes a rotating boss protruding from an inner surface of the insertion body along a circumferential direction, and a rotation groove, formed on an outer surface of the support, for guiding the rotating boss when the support is rotated.

9. The rotary toothbrush according to claim 8, wherein the driving member has a knob installed on an outside of the handle body to be slidably moved in a forward and rearward direction, and locked to a fixing groove formed on the handle body, a rod, integrally connected to the knob in the handle body, for rotating the support, and a restoring member, provided in the handle body, for restoring the rod when the fixing boss is released from the fixing groove.

10. The rotary toothbrush according to claim 9, wherein a pressing boss protrudes from a rear portion of a front end of the rod; a circumferential surface of the support is provided with a front end groove for supporting the front end of the rod when the rod is moved in a forward direction, and a pressing boss groove for supporting the pressing boss at a space spaced apart from the front end groove along a clockwise direction; and when the knob is moved in a forward direction, the support is rotated at a predetermined angle while the front end of the rod is supported by the front end groove, and then the support is further rotated by the pressing boss supported by the pressing boss groove to rotate the support at 90 degrees.

11. The rotary toothbrush according to claim 10, further comprising a cap for covering the insertion body, wherein the driving member further includes a guide boss protruding downwardly from a front end of the cap, and a guide groove recessed on the base in such a way that its depth is deepened from a center to both sides, in which when the base is rotated around the rotating member, the guide boss is moved along the guide groove and is tilted around the tilting member.

12. The rotary toothbrush according to claim 11, wherein the cap has a push-type button for separating the head member.

13. The rotary toothbrush according to claim 12, wherein the inner surface of the insertion body is provided with a partition having an anti-reverse boss for preventing the support from being rotated in a reverse direction after the support is rotated at 90 degrees, and an upper surface of the support is provided with an anti-reverse groove into which the anti-reverse boss is inserted.

14. The rotary toothbrush according to claim 7, wherein an inner surface of the insertion body is provided with a partition having an anti-reverse boss for preventing the support from being rotated in a reverse direction after the support is rotated at 90 degrees, and an upper surface of the support is provided with an anti-reverse groove into which the anti-reverse boss is inserted.

* * * * *